United States Patent [19]

Thomas et al.

[11] Patent Number: 4,832,127

[45] Date of Patent: May 23, 1989

[54] METHOD AND APPARATUS FOR PRODUCING VISCOUS CRUDES

[75] Inventors: David W. Thomas; Robert S. Corby, both of Bakersfield, Calif.

[73] Assignee: Shell Western E&P Inc., Houston, Tex.

[21] Appl. No.: 138,769

[22] Filed: Dec. 29, 1987

[51] Int. Cl.[4] ..... E21B 43/12

[52] U.S. Cl. ..... 166/369; 166/106; 417/431

[58] Field of Search ..... 166/369, 105, 106; 417/431

[56] References Cited

U.S. PATENT DOCUMENTS

| | | | |
|---|---|---|---|
| 1,716,709 | 6/1929 | Smith | 417/431 |
| 4,056,335 | 11/1977 | Secrist | 417/431 |
| 4,100,967 | 7/1978 | Allen et al. | 166/369 X |
| 4,267,888 | 5/1981 | Singer | 417/431 X |

*Primary Examiner*—William P. Neuder

[57] ABSTRACT

To assist electric submersible pumps in producing highly viscous crudes from oil wells, injection water is conveyed to the pump assembly, injected into the crude, and mixed with it to form an oil-in-water emulsion. This effectively decreases the viscosity of the produced fluid and helps to control pump operating temperatures. The water injection is done in a shroud at the base of the submersible pump.

13 Claims, 3 Drawing Sheets

FIG. 2B
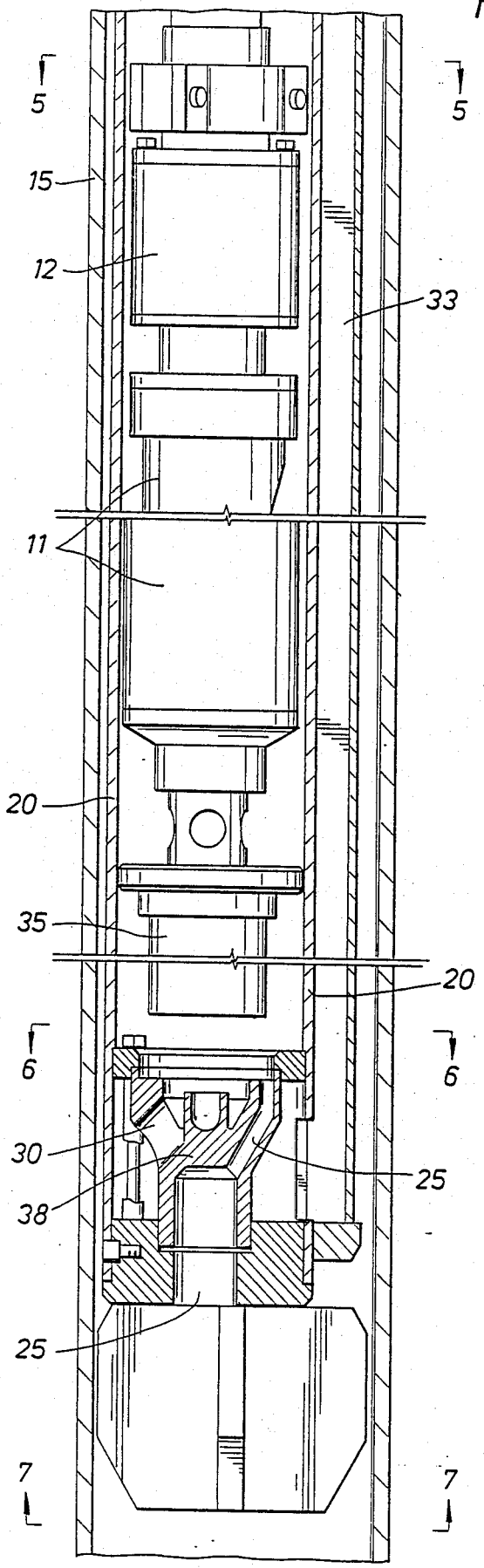
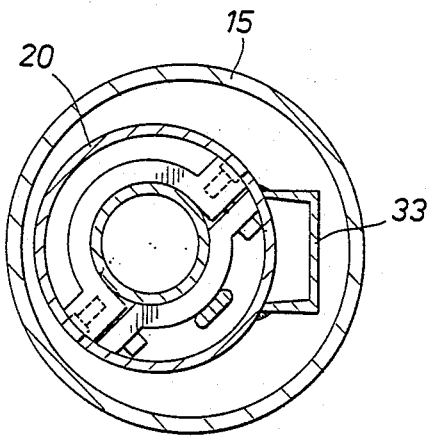
FIG. 5
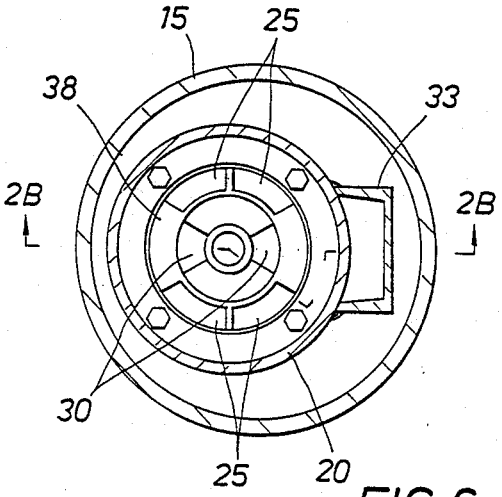
FIG. 6

METHOD AND APPARATUS FOR PRODUCING VISCOUS CRUDES

BACKGROUND OF THE INVENTION

The present invention relates to the production of petroleum, and more particularly to a method and apparatus for producing extremely viscous crude oil from underground reservoirs.

Little by little, the world's easily found and easily produced petroleum energy reserves are becoming exhausted. Consequently, to continue to meet the world's growing energy needs, ways must be found to locate and produce much less accessible and less desirable petroleum sources. Wells are now routinely drilled to depths which, only a few decades ago, were unimagined. Ways are being found to utilize and economically produce reserves previously thought to be unproducible (e.g., extremely high temperature, high pressure, corrosive, sour, and so forth). Secondary and tertiary recovery methods are being developed to recover residual oil from older wells once thought to be depleted after primary recovery methods had been exhausted.

Some crude oils (or, more broadly, reservoir fluids) have a low viscosity and are relatively easy to pump from the underground reservoir. Others have a relatively low viscosity at elevated reservoir temperatures, but become viscous as they cool while being produced. Still others have very high viscosities even at reservoir conditions. It is not uncommon, therefore, for example in California, to find wells with considerable quantities of valuable crude which have nevertheless been shut in because it was too expensive to produce the viscous crude by pumping it out.

A need therefore remains for a new and improved method and apparatus which will change the economics of producing such highly viscous crudes so that these valuable energy reserves can be economically and efficiently produced. Preferably, such a method and apparatus will be uncomplicated and straightforward in design and implementation, versatile, durable, and readily suited to utilization in the widest possible range of viscous crude pumping environments.

SUMMARY OF THE INVENTION

Briefly, the present invention meets the above needs with a new and improved method and apparatus for producing viscous crudes which is particularly well adapted for use with electrical submersible pumps. According to the present invention, water is injected and mixed with viscous crude in a shroud at the base of the submersible pump, thereby decreasing the effective viscosity of the produced fluids and also controlling the pump operating temperature.

Electrical submersible pump lift systems are preferred in certain environments, for example deviated wells such as commonly found in offshore situations, where a plurality of wells is drilled from a single platform. In a deviated well a rod pump can be very difficult to use, partly because the rod tends to rub against the casing and tubing, and partly because the effective pump stroke is significantly shortened as the rod flops up and down within the casing, once each cycle. Also, on offshore platforms the surface equipment for a rod pumped well is much too bulky.

In a preferred embodiment according to the present invention, an electrical submersible pump lift system has an essentially cylindrical shroud which entirely surrounds the lower portion of the pump system. In addition to the usual production string or tubing for carrying the produced wellbore fluids to the surface, the present invention also includes a second string or tubing through which injection water is carried downwardly to the base of the shroud. At the shroud base, the water is then injected into the incoming crude such that the crude and water are mixed before entering the pump intake. Sufficient water is used (a water cut of 55% or more being required) to create a continuous water-wet dispersion or emulsion of the viscous crude oil and the water. In the preferred embodiment, this mixing is facilitiated by causing the initial combined mixture to flow upward through a static mixer.

The water is usually at temperatures below the formation temperature, and the heat capacity of the water is also greater than that of the crude oil. Advantageously, therefore, the water-wet emulsion is next caused to pass in contact with the pump motor in order to assist in reducing its operating temperature. The water-wet emulsion then enters the pump intake for pumping to the surface through the production string.

It is therefore an object of the present invention to provide a new and improved method and apparatus for producing viscous crudes using electrical submersible pumps; such a method and apparatus in which a shroud channels fluids to the inlet of an electrical submersible pump; in which water is conducted from the surface to the shroud inlet and injected into the reservoir fluids at the shroud inlet for mixing therewith; in which the mixed water and reservoir fluids may then be conducted in contact with the outside of the pump motor to assist in cooling the motor; in which an artificial water-cut is thus induced to decrease the effects of viscosity on the components of the electrical submersible pump lift system; in which the volume and heat capacity of the fluids in contact with the motor are thus increased; and to accomplish the above objects and purposes in a manner to reduce the detrimental effects of viscous crudes on electrical submersible pumps, to increase the run life of such pumps, reduce the backpressure thereon, reduce tubing friction losses, positively control the produced water-cut, and in an inexpensive, uncomplicated, durable, versatile, and reliable method and apparatus, inexpensive to manufacture and implement, and readily suited to the widest possible utilization in the production of highly viscous petroleum reserves.

These and other objects and advantages of the invention will be apparent from the following description, the accompanying drawings, and the appended claims.

BRIEF DESCRIPTION OF THE DRAWINGS

FIG. 2B is a continuation of FIG. 2A, showing the lower portion of the apparatus.

FIG. 5 is a cross sectional view taken on line 5-5 in FIG. 2B.

FIG. 6 is a cross sectional view taken on line 6-6 in FIG. 2B.

DESCRIPTION OF THE PREFERRED EMBODIMENT

With reference to the drawings, the new and improved apparatus for producing viscous crudes using electrical submersible pumps, and the method therefor according to the present invention, will be described.

Figure 1:
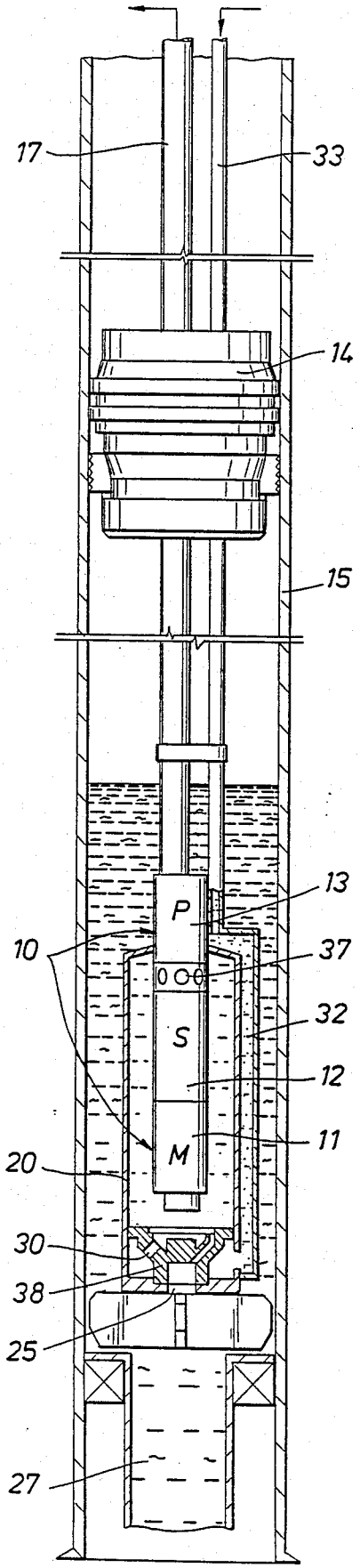
FIG. 1 is a greatly simplified, schematic, partially sectioned elevational view of an apparatus for producing viscous crudes according to the present invention, located within a cased and producing wellbore.
Figure 7:
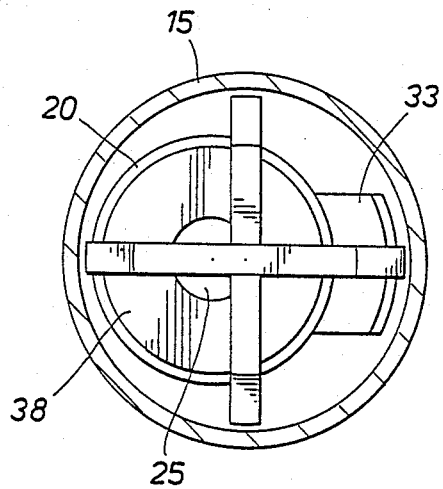
FIG. 7 is a cross sectional view taken on line 7-7 in FIG. 2B.
Figure 2A:
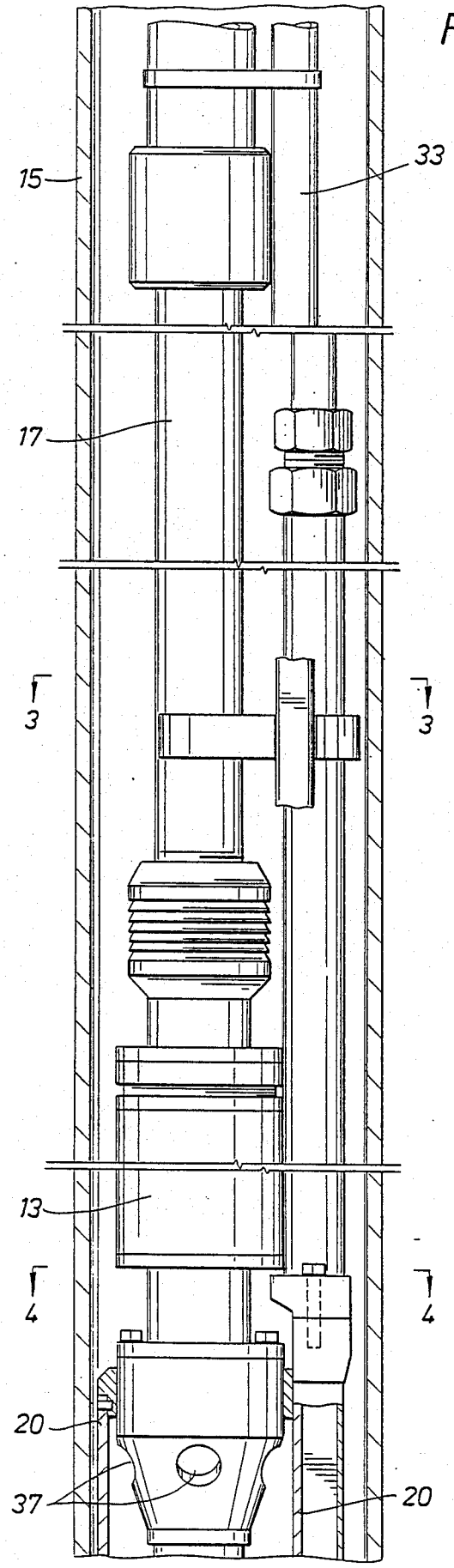
FIG. 2A is a somewhat foreshortened, detailed view of the top portion of a preferred embodiment of the invention illustrated schematically in FIG. 1.
Figure 3:
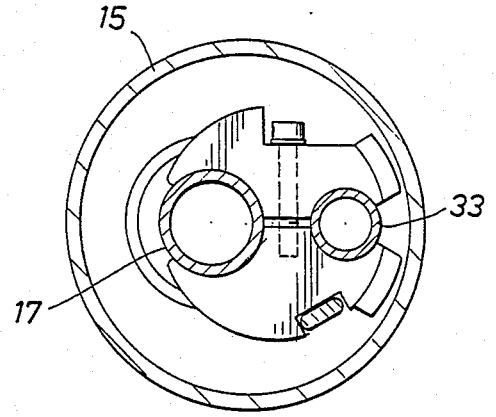
FIG. 3 is a cross sectional view taken on line 3-3 in FIG. 2A.
Figure 4:
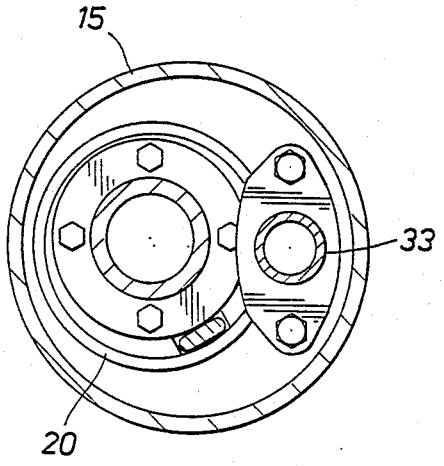
FIG. 4 is a cross sectional view taken on line 4-4 in FIG. 2A.

The overall layout of the invention may be seen in FIG. 1, where a conventional electrical submersible pump assembly 10, consisting of a motor 11, seal 12, and pump 13, is suspended downhole beneath a packer 14 in the casing 15 of an oil well. Fluids exiting the pump assembly 10 are conveyed to the surface through a conventional production string 17.

Surrounding the electrical submersible pump assembly 10 is a shroud 20. In the preferred embodiment, shroud 20 extends entirely around and below the pump assembly 10 so that the fluids being pumped thereby will flow past and in contact with the pump motor 11. Thus, shroud 20 has inlet 25 at the bottom thereof for the wellbore fluids 27. Also located at the bottom or base of shroud 20 is a water injector 30 for injecting water 32 conveyed thereto from the surface by an injection water string 33. Where appropriate, injector 30 may be designed to jet the water 32 into the incoming reservoir fluid 27 in the inlet 25 of the shroud 20.

As will be clear from the drawing figures, the injection water 32 is thus injected into the wellbore fluids as they enter the shroud 20, upstream from (although physically below) the pump and pump inlet. The objective is to reduce the effective viscosity of the fluids by creating a water-continuous dispersion or emulsion, which requires relatively intimate mixing of the viscous crude oil 27 and the water 32. Such mixing, of course, will ultimately take place within the pump 13. However, in the preferred embodiment it is considered desirable to have the emulsion reasonably well formed before it gets to the pump impeller so that the operation of the pump impeller will be more efficient, as further described below. The preferred embodiment thus includes a static mixer 35 in the flow path between the shroud inlet 25 and the pump intake 37. Static mixer 35, in the preferred embodiment, is simply any appropriate commercially available static diffuser, such as a Koch Static Mixing Assembly (available from Koch Engineering Company, Inc., Wichita, Kans.) consisting of four type SMX elements made of 316SS and housed in a 3" schedule 40 carbon steel pipe, 15" overall length. The particulars of the diffuser are not critical, however, and may be varied as desired or appropriate. Other appropriate mixers may be obtained from Ross Mixers (Savannah, Ga.) and Komax (Long Beach, Calif.).

Injection of the water and initial mixing with the wellbore fluids 27, in the preferred embodiment, is also facilitated by passing them simultaneously through an inverted crossover diffuser 38 from a 513 Series Centrilift separator (available from Baker/Hughes Centrilift factory, Huntington Beach, Calif.), which was easier and less expensive than custom fabricating injector nozzles.

The operation of the invention is thus quite straightforward. The second string 33 brings the injection water 32 to the shroud 20 where effective mixing of the wellbore fluids 27 with the additional injection water 32 takes place. The mixed fluids then pass upwardly by the electric pump motor 11 to cool it, and then enter the pump intake 37 for pumping to the surface through the production string 17. Advantageously, sufficient water 32 can be initially supplied such that the electrical submersible pump 13 can be started with a 100% water-cut.

Mixing the highly viscous crude 27 with the additional injection water 32 has several significant advantages. The actual viscosity of the oil itself, of course, remains unchanged. However, the "effective" viscosity of the fluid to be pumped is significantly reduced if sufficient water is employed to create an effective water-wet emulsion. In such a case, the water lubricates the pump, and the pump impellers essentially see water, not the suspended or emulsified oil therein. The load on the pump is thus very substantially reduced because it does not have to overcome the substantial drag of a highly viscous crude oil. In the preferred embodiment, a water cut of around 55% or more has been found to be highly effective, and to be essentially independent of the viscosity of the particular crude 27 being produced. Pump energy consumption is thus substantially diminished, pump efficiency is accordingly improved, pump heating and the requirements for cooling the pump are correspondingly reduced, and viscous drag of the fluids flowing through the production string 17 to the surface is also very greatly reduced.

As an example of the effectiveness of the present invention, it has been used successfully to produce, at commercially acceptable net rates and costs, an average of 225 barrels of oil per day from a well which had been previously shut-in for one and a half years. In fact, the well had been shut-in due to the unfavorable economics of producing the highly viscous crude in the well. With the present invention, however, injecting 300–1200 barrels of water per day (58%–84% blended water-cut), the well is now commercially successful.

As may be seen, therefore, the present invention has numerous advantages. Through the introduction of a suitable fluid from the surface into the producing wellbore, the detrimental effects of the viscous oil on the performance of an electrical submersible pump are substantially reduced. An injection water side string is incorporated along with a modified motor shroud for generating a homogeneous mixture of oil dispersed in water, introducing it to the pump intake, and also causing it to travel along the outside of the motor to facilitate improved motor cooling. Detrimental effects of viscous crudes on the electrical submersible pump are thus decreased, and the run life of the electrical submersible pump motor is accordingly increased. Pump motor life is further increased due to the increased cooling thereof. Backpressure on the pump is decreased and tubing friction losses during production are reduced. Additionally, the present invention allows the produced water-cut to be positively controlled. Also, pump selection may be made with greater accuracy and without the need for large viscosity correction factors. Further, the injection water 32 may be used for the controlled addition of chemicals, such as for scale inhibition, corrosion control, and/or further viscosity reduction.

Thus, while the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. Apparatus for producing viscous crudes from a producing wellbore, comprising:

(a) an electrical submersible pump lift system;

(b) a shroud having an inlet for reservoir fluids containing such viscous crudes, said shroud substantially surrounding the inlet to said electrical submersible pump;

(c) a water conduit for conducting water from the surface to said shroud inlet; and (d) water inlet means connected to said water conduit and communicating with the crude inlet of said shroud for continuously injecting water into said crude inlet and mixing such water with reservoir fluids coming in through said crude inlet.

2. The apparatus of claim 1 wherein said shroud further includes means for substantially surrounding the motor of said submersible pump whereby the mixed water and reservoir fluids may contact said motor to assist in cooling said motor.

3. The apparatus of claim 1 further comprising mixing means in said shroud for mixing said injected water with the reservoir fluids upstream from the inlet to said electrical submersible pump to produce a substantially homogeneous mixture of oil dispersed in water for introduction into said pump.

4. The apparatus of claim 3 wherein said mixing means further comprises a static mixer disposed in the flow path between said crude inlet and the inlet of said submersible pump.

5. Apparatus for producing viscous crudes from a producing wellbore, comprising:

(a) an electrical submersible pump lift system;

(b) a substantially cylindrical shroud having an inlet on the bottom thereof for reservoir fluids containing such viscous crudes, said shroud substantially surrounding said electrical submersible pump and extending downwardly therebeneath;

(c) a water conduit for conducting water from the surface to said shroud inlet;

(d) water inlet means connected to said water conduit and communicating with the crude inlet of said shroud for continuously injecting water into said crude inlet and mixing such water with reservoir fluids coming in through said crude inlet;

(e) a static mixer in said shroud for mixing such injected water with the reservoir fluids above and upstream from the inlet to said electrical submersible pump to produce a substantially homogeneous mixture of oil dispersed in water for introduction into said pump; and (f) said shroud including means for substantially surrounding the motor of said submersible pump whereby the mixed water and reservoir fluids may contact said motor of said electrical submersible pump to assist in cooling said motor, whereby the detrimental effects of viscous crudes on said electrical submersible pump are decreased, the run life of said electrical submersible pump motor is increased due to the increased cooling thereof, the back pressure on said electrical submersible pump is decreased, tubing friction losses during production are reduced, the produced water cut may be positively controlled, and pump selection may be made without the need for large viscosity correction factors.

6. A method using an electrical submersible pump lift system for producing viscous crudes from a producing wellbore, comprising:

(a) inducing an aritifical water-cut into the viscous crudes to create a water-wet emulsion to decrease the effects of viscosity on the components of the electrical submersible pump lift system by injecting water into the crude inlet at the base of a shroud which substantially surrounds the electrical submersible pump lift system;

(b) intimately mixing the water and viscous crude by jetting the water into the viscous crude to draw the viscous crude into the inlet of the pump;

(c) by means of the induced artificial water-cut, increasing the volume and heat capacity of the fluids in contact with the motor of the electrical submersible pump lift system to reduce its operating temperature; and (d) producing the injected water and the viscous crudes through the electrical submersible pump lift system.

7. The method of claim 6 wherein said intimate mixing step further comprises causing the mixture of the viscous crude and the injected water to flow through a static mixer.

8. The method of claim 6 further comprising starting up the electrical submersible pump with a substantially 100% water-cut.

9. The method of Claim 6 further comprising adding chemicals to the injected water.

10. The method of claim 9 wherein said step of adding chemicals to the injected water further comprises adding chemicals for scale inhibition.

11. The method of claim 9 wherein said step of adding chemicals to the injected water further comprises adding chemicals for corrosion control.

12. The method of claim 9 wherein said step of adding chemicals to the injected water further comprises adding chemicals for viscosity reduction.

13. A method using an electrical submersible pump lift system for producing viscous crudes from a producing wellbore, comprising:

(a) inducing an artificial water-cut into the viscous crudes by injecting water into the crude inlet at the base of a shroud which substantially surrounds the electrical submersible pump lift system, to mix the water with viscous crudes coming in through the shroud inlet and decrease the effects of viscosity on the components of the electrical submersible pump lift system;

(b) adding chemicals to the injected water;

(c) mixing sufficient water with the viscous crudes to create a water-wet emulsion, thereby reducing viscosity effects on the pump and increasing heat transfer from the motor;

(d) intimately mixing the water with the viscous crudes by jetting the water into the viscous crude to draw the viscous crude into the inlet of the shroud and then causing the mixture of the viscous crude and the injected water to flow through a static mixer;

(e) by means of the induced artificial water-cut, increasing the volume and heat capacity of the fluids in contact with the motor of the electrical submersible pump lift system to reduce its operating temperature; and (f) producing the injected water and the viscous crudes through the electrical submersible pump lift system, whereby the detrimental effects of viscous crudes on the electrical submersible pump are decreased, the run life of the electrical submersible pump motor is increased due to the increased cooling thereof, the back pressure on the electrical submersible pump is decreased, tubing friction losses during production are reduced, the produced water cut may be positively controlled, and pump selection may be made without the need for large viscosity correction factors.

* * * * *